US007448391B2

(12) United States Patent
Funke et al.

(10) Patent No.: US 7,448,391 B2
(45) **Date of Patent: *Nov. 11, 2008**

(54) METHOD AND DEVICE FOR THE SEPARATION OF FOREIGN BODIES

(75) Inventors: Peter Funke, Hamburg (DE); Dietmar Zielke, Hamburg (DE); Harry Drewes, Hamburg (DE); Wolfgang Benz, Boernsen (DE)

(73) Assignee: Hauni Primary GmbH, Schwarzenbek (DE)

( * ) Notice: Subject to any disclaimer, the term of this patent is extended or adjusted under 35 U.S.C. 154(b) by 380 days.

This patent is subject to a terminal disclaimer.

(21) Appl. No.: 11/087,611

(22) Filed: Mar. 24, 2005

(65) Prior Publication Data

US 2005/0211257 A1 Sep. 29, 2005

(30) Foreign Application Priority Data

Mar. 26, 2004 (DE) ..... 10 2004 015 463

(51) Int. Cl.
*A24C 5/18* (2006.01)

(52) U.S. Cl. ..... 131/286; 131/287

(58) Field of Classification Search ..... 131/286, 131/287

See application file for complete search history.

(56) References Cited

U.S. PATENT DOCUMENTS

| | | | | |
|---|---|---|---|---|
| 4,580,579 | A * | 4/1986 | Wahle et al. | 131/84.3 |
| 4,627,447 | A * | 12/1986 | Brackmann et al. | 131/109.1 |
| 4,685,476 | A * | 8/1987 | Hagemann et al. | 131/110 |
| 5,558,199 | A | 9/1996 | Roether et al. | |
| 6,332,543 | B1 | 12/2001 | Niehues et al. | |
| 2004/0040564 | A1 | 3/2004 | Kuhl et al. | |
| 2005/0199252 | A1 | 9/2005 | Coleman | |

FOREIGN PATENT DOCUMENTS

| | | |
|---|---|---|
| DE | 4030344 | 4/1992 |
| DE | 4325838 | 2/1995 |
| DE | 19516568 | 11/1996 |
| DE | 19537846 | 11/1996 |
| DE | 19531057 | 4/1997 |
| DE | 19642736 | 4/1997 |
| DE | 19744246 | 4/1999 |
| DE | 10037180 | 1/2002 |
| EP | 1027837 | 8/2000 |
| EP | 1576897 | 9/2005 |
| GB | 955846 | 4/1964 |
| GB | 1034649 | 6/1966 |
| WO | 90/06065 | 6/1990 |

* cited by examiner

*Primary Examiner*—Carlos Lopez
(74) *Attorney, Agent, or Firm*—Greenblum & Bernstein, P.L.C.

(57) ABSTRACT

The invention relates to a method for the separation of foreign bodies and a device for the separation of foreign bodies from a tobacco stream. The method according to the invention is characterized in that the tobacco stream is directly conveyed into the area of the foreign-body detection device with compressed air and whereby foreign bodies in the tobacco stream are identified by means of the foreign-body detection device based on at least one characteristic and subsequently removed from the tobacco stream. The A device according to the invention is characterized in that a device (feeding device) feeding the tobacco to a foreign-body detection device and a foreign-body separation device are provided, whereby the tobacco feeding device for conveying the tobacco stream comprises a source of compressed air.

16 Claims, 5 Drawing Sheets

METHOD AND DEVICE FOR THE SEPARATION OF FOREIGN BODIES

CROSS-REFERENCE TO RELATED APPLICATIONS

The present application claims priority under 35 U.S.C. §119 of German Patent Application No. 10 2004 015 463.5-23 filed on Mar. 26, 2004. The disclosure of the foregoing application and each U.S. and foreign patent and patent application mentioned herein are incorporated herein by reference.

BACKGROUND OF THE INVENTION

1. Field of the Invention

The invention relates to a method and a device for the separation of foreign bodies from a tobacco stream.

2. Discussion of Background Information

A corresponding device is, for example, known from the applicant's U.S. Pat. No. 6,332,543 B1. In this known device, a tobacco stream is brought into the area of an optical foreign-body detection device by means of conveyors, in particular a trough conveyor and conveyor belts. As soon as a foreign body is identified in the tobacco stream by means of the foreign-body detection device, the foreign body or foreign bodies are removed from the tobacco stream by means of compressed air cross-wise to the conveying direction.

SUMMARY OF THE INVENTION

The object of this invention is to provide an additional version of a method and a device for foreign-body separation from a tobacco stream.

This object is attained by a method for the separation of foreign bodies from a tobacco stream, whereby the tobacco stream is directly conveyed to the area of a foreign-body detection device with compressed air and whereby foreign bodies are identified in the tobacco stream via the foreign-body detection device by means of at least one characteristic. Through the method according to the invention, it is in particular possible to convey the tobacco stream and the foreign bodies found in the tobacco stream with a higher speed than in the state of the art so that, with the same procedural capacity, a device that performs the procedure, which is smaller in size, can be used.

Within the framework of the invention, the word "characteristic" means in particular an optical property of the tobacco or of the foreign body, such as at least one of luminosity, shape and color or another physical characteristic, such as the moistness, the specific weight, or the presence of corresponding elements (carbon or metals, etc.). The foreign-body detection is preferably effected by means of the ascertainment of the luminosity and/or the color of the objects contained in the tobacco stream. The word "objects" means in particular tobacco, tobacco leaves, cut tobacco, and foreign bodies. The speed of the tobacco stream is preferably between 6 m/s and 30 m/s, in particular between 17 m/s and 30 m/s. The preferred speed provides for a very effective conveyance of the tobacco stream.

If the tobacco stream is dispersed cross-wise to the conveying direction, little tobacco or tobacco leaves or cut tobacco is separated during the separation of foreign bodies. Furthermore, this enables an improved rate of foreign-body detection, since a relatively thin layer of a tobacco stream cross-wise to the conveying direction of the tobacco stream can be correspondingly evaluated with the foreign-body detection device. The tobacco stream is also preferably dispersed cross-wise to the measurement direction of the foreign-body detection. The direction of the foreign-body detection and the conveying direction are also preferably cross-wise to each other.

If the tobacco stream is tapered cross-wise to the conveying direction, the result is improved foreign-body detection. The tobacco stream is preferably tapered in the direction of the foreign-body detection. The foreign-body detection can hereby take place with a high degree of efficiency. Only a thin layer of the tobacco stream needs to be examined, whereby the foreign bodies can be better detected through lower rates of coverage with tobacco. Within the framework of the invention, the direction of the foreign-body detection, in particular during an ultrasonic measurement procedure, is the direction of the ultrasonic waves sent towards the tobacco stream or, during a microwave procedure, the direction of the microwaves directed at the tobacco stream.

The foreign body or foreign bodies is/are preferably removed from the tobacco stream with compressed air. Alternatively, foreign bodies can also be removed from the tobacco stream by means of a fluid stream, such as a stream of water. If, after the foreign-body detection, the tobacco stream is conveyed further by means of suction air, an uninterrupted tobacco stream is possible and correspondingly high transfer rates are possible. Preferably, the tobacco stream is at least partially conveyed basically horizontally. In this embodiment of the invention, it makes sense to achieve tobacco-stream speeds of at least 12 m/s, which is commensurate with a conveying-air speed of approx. 17 m/s. If, in contrast, the tobacco stream is at least partially conveyed basically vertically, the gravitational force can also be utilized and the speed of the tobacco stream or the speed of the compressed air, which then contributes to the conveyance of the tobacco stream, can be lower.

The object is further attained through a device for foreign-body separation from a tobacco stream, whereby a device feeding the tobacco to a foreign-body detection device (feeding device) and a foreign-body separation device is provided, whereby the feeding device comprises a source of compressed air for the conveyance of the tobacco stream.

The device according to the invention can be designed very small through the use of a source of compressed air and the subsequent relatively high conveying speeds of the tobacco stream. There is preferably a stream of compressed air that conveys the tobacco stream in the feeding device. In particular, the stream of compressed air conveys the tobacco stream directly to the foreign-body detection device.

A particularly simple and cost-effective embodiment of the device according to the invention is given if the feeding device comprises a channel with a closed cross-section, in which the tobacco is conveyed or is conveyable. A particularly good dosage is possible if tobacco can be conveyed into the stream of compressed air via a sluice. The sluice is preferably a star wheel airlock. A particularly good foreign-body separation rate is given when the channel opens directly in front of at least one of the foreign-body detection device and the foreign-body separation device.

The foreign-body detection efficiency is increased when the channel is designed to taper in the conveying direction at least in sections in a direction cross-wise to the conveying direction. When the channel is dispersed in a funnel-shaped manner at least in sections in the conveying direction, a particularly effective and tobacco-saving separation of foreign bodies is possible. The channel is preferably designed at the outlet in the form of a rectangular nozzle so that an increase in speed occurs during the discharge of the tobacco. The cross-section is then preferably decreased at the outlet. A particularly simple foreign-body detection is then possible if the foreign-body detection device is optical.

The channel preferably extends in the conveying direction of the tobacco stream over and beyond the foreign-body separation device. A very efficient tobacco flow can be obtained through this preferable embodiment of the device according to the invention, whereby the foreign-body detection rate is increased.

The channel is preferably closed on one side in the area of the foreign-body separation device or comprises a cover. Through this measure, a flow can be obtained preferably by using the Coanda effect on the closed side of the channel or on the side of the channel that is provided with the cover, whereby a very good foreign-body detection rate is enabled.

At least one wall of the channel is preferably designed to be straight in the conveying direction at least in sections. Two opposite-lying walls, in particular and preferably two opposite-lying narrower lateral walls of the channel are preferably designed to be straight at least in sections. The straight construction of at least one wall is preferably adjacent to the end of the channel, on which at least one of the foreign-body detection device and the foreign-boy separation device is arranged downstream.

Other exemplary embodiments and advantages of the present invention may be ascertained by reviewing the present disclosure and accompanying drawings.

BRIEF DESCRIPTION OF THE DRAWINGS

The present invention is further explained in the detailed description which follows with the aid of exemplary embodiments, but without limiting the general inventive idea, in reference to the drawings, in which like reference numerals represent similar parts throughout the several views of the drawings.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the figures the same or similar elements or corresponding parts are respectively provided with the some reference numbers, so that a corresponding renewed introduction is unnecessary and only deviations of the exemplary embodiments in these figures from the first exemplary embodiment are explained.

Figure 1:
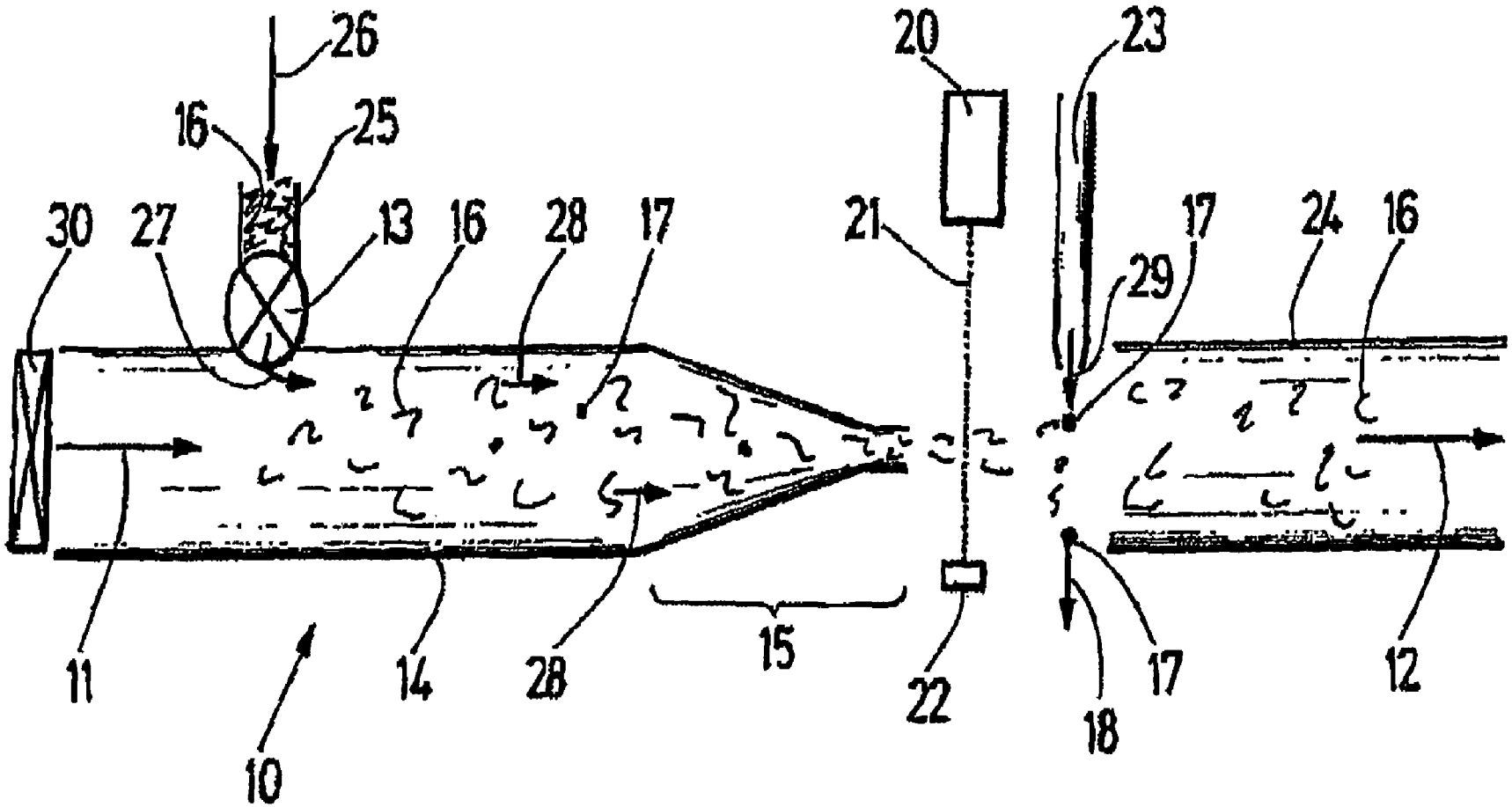
FIG. 1 illustrates a schematic representation of a device for foreign-body separation according to the invention.
Figure 3:
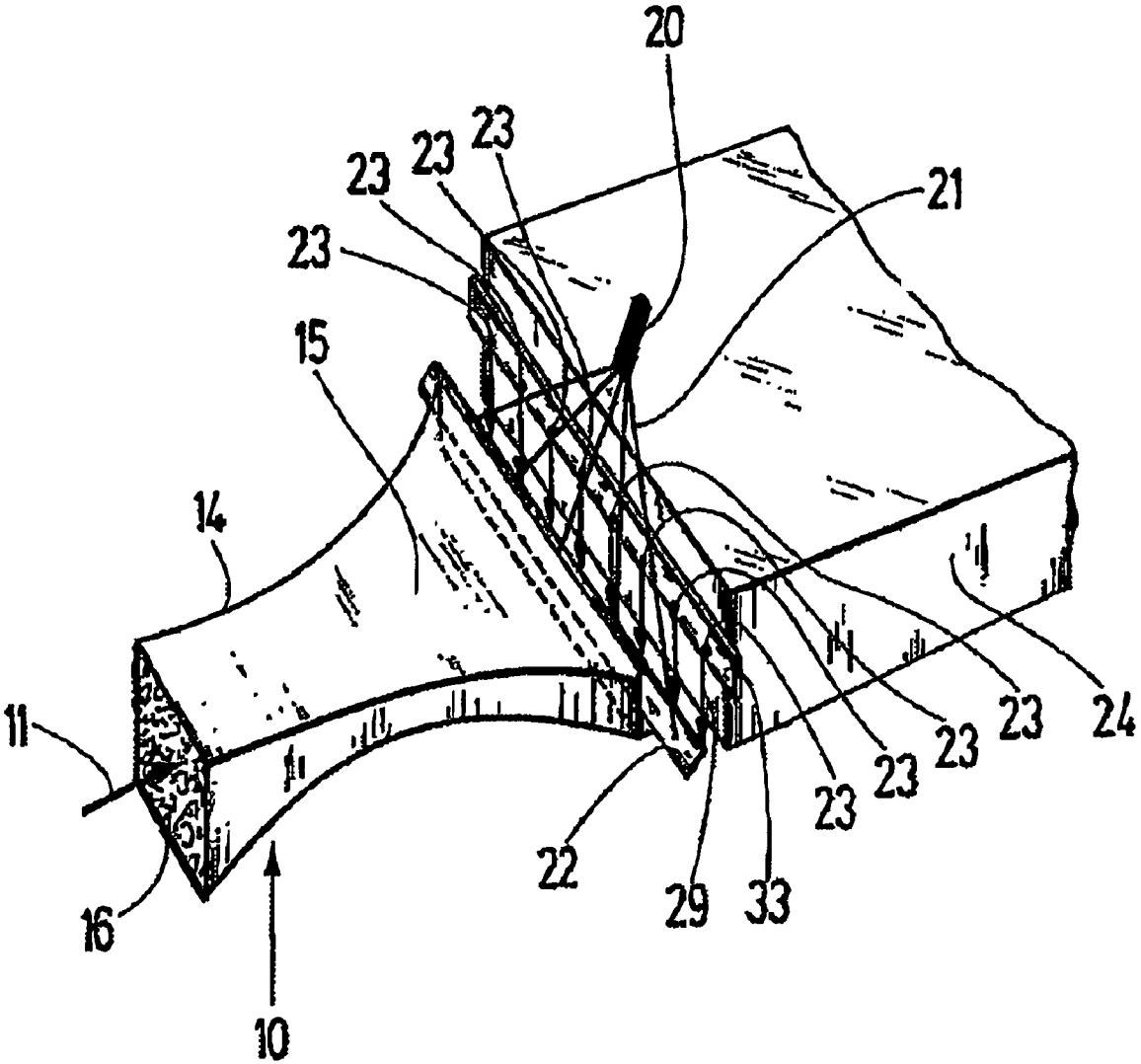
FIG. 3 illustrates a schematic three-dimensional representation of part of another embodiment of a device for foreign-body detection.

FIG. 1 shows a schematic representation of a device for foreign-body separation according to the invention. A tobacco feeding device 10 is illustrated that, in particular, comprises a tube 14, in which a stream of tobacco 16 is created in the conveying direction 28 by a stream of compressed air 11 created by a source of compressed air 30. For example, tobacco is dosed via a star wheel airlock 13 from a bulking chute or drop duct or a tobacco tube 25, which is conveyed into the tobacco tube 25 in the conveying direction 26, provided in conveying direction 27 into tube 14, and contributes to the tobacco stream. Foreign bodies 17 are also located in the tobacco stream, which is inserted in the tube 14 and correspondingly conveyed. The tube 14 is designed to taper in the direction of a foreign-body detection device, in this case comprising a laser 20, which creates a fan of beams 21 by means of an optical system (not shown), and a CCD line (Charged Coupled Device line) 22, which can also be a camera, and is designed to broaden in a direction turned 80° and ends in a nozzle 15, which is illustrated in FIG. 3. The tube 14 is correspondingly flattened and dispersed in the area of the nozzle 15, so that the tobacco 16 in the tobacco stream is dispersed and a thinner layer correspondingly gets through the fan of beams 21 so that the efficiency of the foreign-body detection is increased.

A correspondingly identified foreign body 17 is, for example, detected through a larger absorption of the beam broken down by location via the CCD line 22 and is separated from the tobacco stream by means of compressed air 29 by activating a nozzle 23 in the separation direction 18. The tobacco stream is conveyed basically or completely freed from the foreign bodies 17 through suction air 12 in the conveying tube 24. It makes sense to provide the suction air 12 in the conveying tube in such a way that all tobacco components 16 of the tobacco stream are taken along.

FIG. 1 represents a horizontal embodiment of the invention, in which the tobacco stream consisting of tobacco parts 16 is mainly conveyed horizontally.

Figure 2:
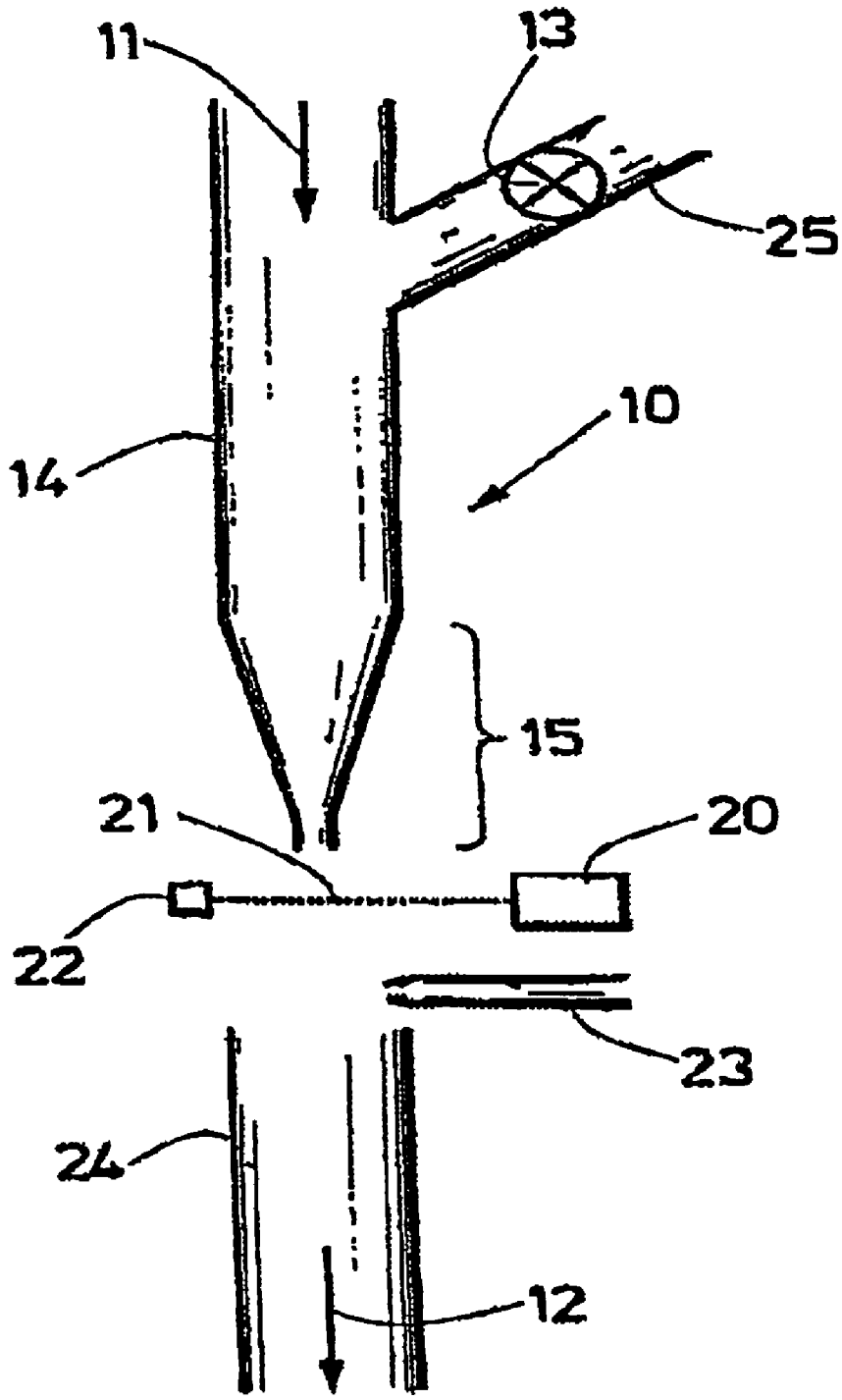
FIG. 2 illustrates a schematic representation of an alternative embodiment of the device for foreign-body detection according to the invention.

FIG. 2 shows a schematic representation of an alternative embodiment of the device according to the invention, in which the tobacco is conveyed vertically. Moreover, the tobacco tube 25 is designed to discharge into the tube 14 in a sloped manner and the star wheel airlock 13 also does not discharge directly into the tube 14. Otherwise, the features correspond with those from FIG. 1. In this case, the compressed air speed 11 need not be set as high as in the exemplary embodiment in accordance with FIG. 1, since, in addition to the compressed air, the gravitational force also plays a role.

FIG. 3 shown a three-dimensional representation of a schematic section from a device according to the invention. The expanded or dispersed and flattened tube 14 in the area of the nozzle 15 is particularly easy to see. The tube 14 has a rectangular or square cross-section. However, it can also have a different shape. Furthermore, corresponding arrows 29 show that corresponding foreign bodies broken down by location can be removed from it so that low tobacco loss occurs. A nozzle rail 33, which has corresponding individual nozzles 23, is also shown. The nozzles 23 are only indicated schematically in FIG. 3. These preferably lie close to each other and there are preferably more of them than shown in the illustration.

Instead of the illustrated optical foreign-body detection, any other conceivable foreign-body detection can also be used, such as a foreign-body detection based on heat, on sound waves, or on microwaves.

For foreign-body separation with optical methods, the product, i.e. the tobacco stream or the tobacco, should be dispersed such that the camera or the laser scan has a clear view of or access to the surface of the product. In order to achieve a good discharge rate, the quality of the product presentation should be at least as important as the technology of the image processing. The dispersion systems known in the state of the art work with tobacco-stream speeds in the range of 5.5 m/s and in a case of free fall in the range of 3.0 m/s. It makes sense for optical detection to disperse the tobacco stream or the tobacco down to a monolayer, whereby the surface weight is very low so that a corresponding device in accordance with the state of the art has a relatively large nominal width. Moreover, it is relatively difficult in the state of the art to achieve a good monolayer or a thin layer of tobacco in the tobacco stream.

The pneumatic conveyance of the tobacco stream is critical to the invention. Correspondingly high speeds between 15 m/s and 30 m/s are hereby possible. Known CCD line cameras provide scan rates or image rates or readout times that can completely examine the surface of the product even at these speeds. The invention makes it possible to present a tobacco stream such that, at a correspondingly high speed, in particular examined optically, foreign bodies can also be selectively discharged with air nozzles or water nozzles. This has the advantage that the corresponding device for foreign-body separation can have a smaller width and that a better spread of the tobacco in the tobacco stream is enabled.

Figure 4:
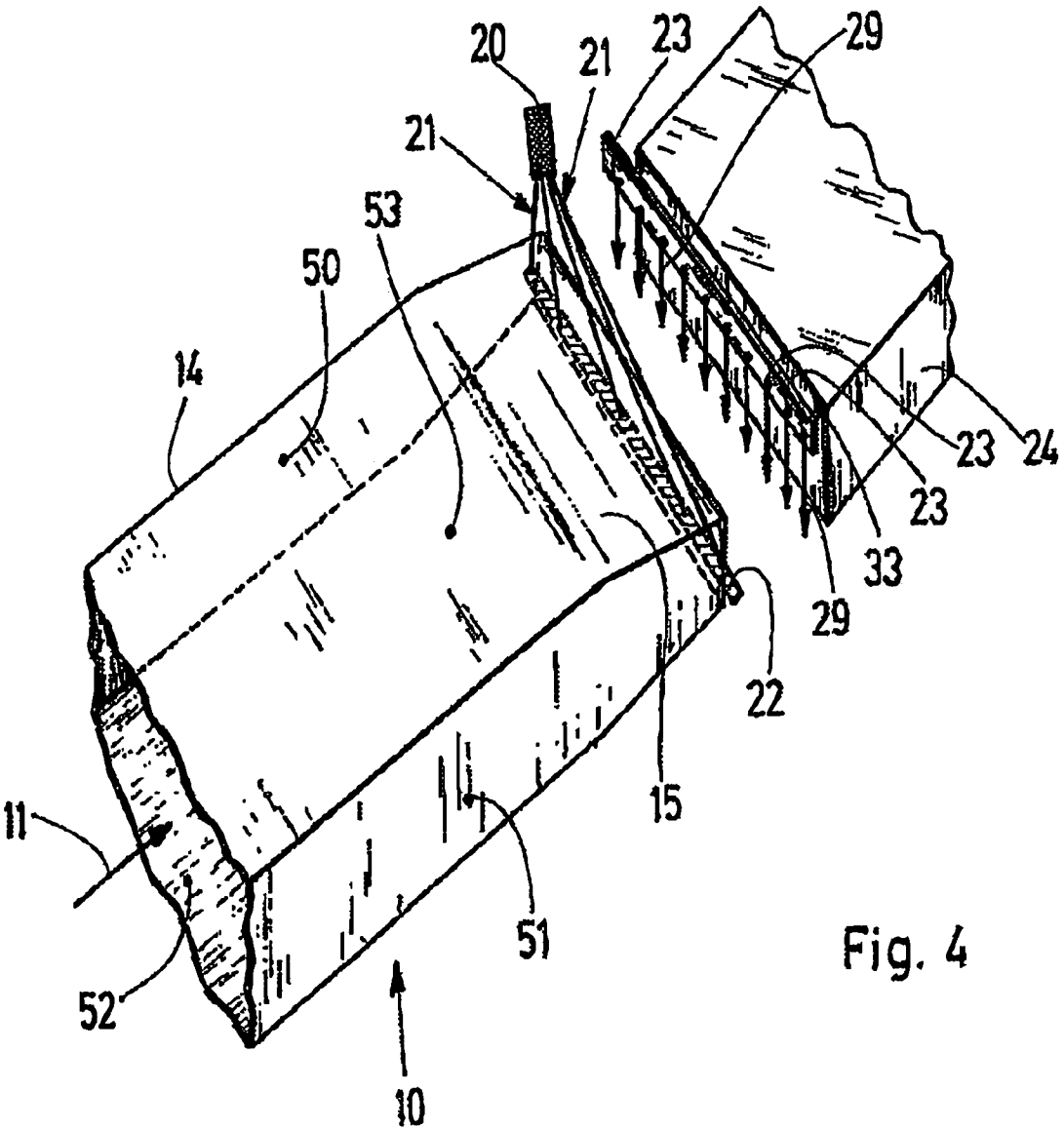
FIG. 4 illustrates a schematic three-dimensional representation of part of another embodiment of a device for foreign-body detection.

FIG. 4 shows another schematic three-dimensional representation of a part of another embodiment of a device for foreign-body detection.

In relation to FIG. 3, channel 14 in particular is designed differently. Two opposite lying walls 50 and 51 are represented that are basically arranged parallel to each other and straight. This means that they are designed not to tapered with respect to each other in the discharge area or in the nozzle area 15, but rather continue to be straight or parallel to each other. In contrast, the lower wall 52 and the upper wall 53 in the area 15 are designed to taper in the conveying direction of the compressed air 11 in order to achieve a nozzle effect. Upstream from the nozzle area 15, the lower wall 52 and the upper wall 53 can also be parallel to each other.

Compared to FIG. 3, the distance between channel 14 and the conveying tube 24 is somewhat larger in order to enable a timely activation of the corresponding nozzle 23 for an arithmetic unit, which services to control the nozzles 23, around the nozzle rail 33 for corresponding foreign-body detection through the detection of a corresponding foreign body by means of the CCD line 22 also at high conveying speeds.

Figure 5:
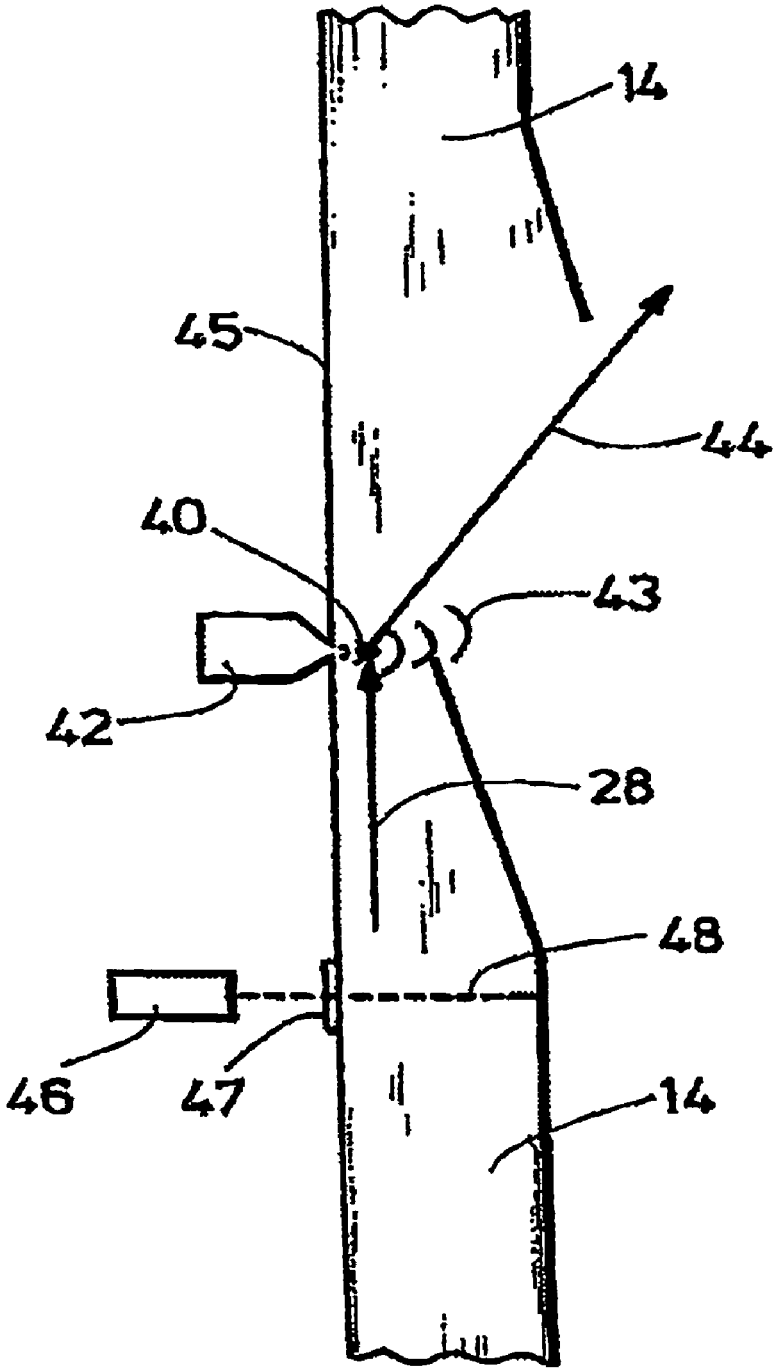
FIG. 5 illustrates a schematic sectional view of an alternative embodiment of the device for foreign-body detection according to the invention.

FIG. 5 shows a schematic sectional view of another embodiment of the device for foreign-body detection according to the invention. It concerns a channel 14 that is closed on one side. The air flow utilizing the so-called Coanda effect is applied to the rear panel 45 in this channel 14 that is closed on one side. After identifying a foreign body by means of a camera 46, which identifies foreign bodies in the observation plane 48 through the window 47, the foreign body 40 is diverted from the conveying direction 28 by a pressure surge 43 created by the air nozzle 42 after a corresponding time delay depending on the conveying speed of the tobacco stream including the foreign body, so that the foreign body 40 ends up on the diverted trajectory 44. The foreign body 40 is hereby discharged from the channel 14. The channel 14 is designed such that, in the conveying direction, in front of, i.e. upstream from, the air nozzle 42, a reduction of the cross-sectional surface of the channel 14 takes place, and, in the area in which the tobacco stream freed of the foreign body 40 is conveyed further, the cross-section is first somewhat enlarged and becomes smaller in sections, down to the original cross-sectional surface of the tube 14. The position of the camera 46 lies sufficiently far in front of the nozzle 42 or the nozzles 42 so that the camera 46 identities the foreign body 40 early enough that enough computing time remains for the identification of the foreign body and the controlling of the air nozzle 42. Thus, the schematically represented nozzle 42 can also be a nozzle rail in accordance with FIG. 3 or 4.

The rear panel 45 is basically uninterrupted; that is, the channel 14 extends over and beyond the foreign-body separation device. The rear panel 45 is only open through the nozzle opening in the area of the nozzle 42, preferably in a circular manner, which does not lead to corresponding streaming disruptions, since the disruption is sufficiently small.

The camera 46 has a separate view opening into channel 14, which can also be closed by a transparent material, such as glass, in the form of a window 47. A corresponding opening without a window can also be provided for this.

Instead of the continuous rear panel 45, a cover, which is not shown in the figures, can also be provided. The cover serves, for example, to cover the upper area between the channel 14 and the conveying tube 24 in the FIGS. 1, 3, and 4 as well as the lateral walls, as necessary. The channel 14 can be correspondingly connected with the conveying tube 24 or can be one piece, reaching so far that the area between the channel 14 and the conveying tube 24 except for the area, which is required for the discharging of the foreign bodies, in particular in the blow-out inflow area, is connected or one piece. The discharge area for the foreign bodies can, as shown in FIG. 5, also be optionally designed in a more open manner.

It in noted that the foregoing examples have been provided merely for the purpose of explanation and are in no way to be construed as limiting of the present invention. While the present invention has been described with reference to an exemplary embodiment, it is understood that the words of which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Tobacco feeding device
11 Compressed air
12 Suction air
13 Star wheel airlock
14 Tube
15 Nozzle area
16 Tobacco
17 Foreign body
18 Separation direction
20 Laser
21 Fan of beams
22 CCD line
23 Nozzle
24 Conveying tube

25 Tobacco tube
26 Conveying direction
27 Conveying direction
28 Conveying direction
29 Compressed air
30 Source of compressed air
33 Nozzle rail
40 Foreign body
42 Air nozzle
43 Pressure surge
44 Diverted trajectory
45 Rear panel
46 Camera
47 Window
48 Observation plane
50 Wall
51 Wall
52 Wall
53 Wall

What is claimed:

1. A method for the separation of foreign bodies from a tobacco stream, comprising:

directly conveying the tobacco stream into the area of a foreign-body detection device with compressed air;

identifying foreign bodies in the tobacco stream by the foreign-body detection device based on at least one characteristic; and subsequently removing the identified foreign body from the tobacco stream, wherein the tobacco stream is dispersed cross-wise to the conveying direction and is tapered cross-wise to the conveying direction.

2. A method according to claim 1, wherein the foreign-body detection takes place by ascertaining at least one of luminosity, shape and color of objects contained in the tobacco stream.

3. A method according to claim 1, wherein the speed of the tobacco stream is between 17 and 30 m/s.

4. A method according to claim 1, wherein the foreign bodies are removed from the tobacco stream with compressed air or a fluid stream.

5. A method according to claim 1, wherein the tobacco stream is conveyed further after the foreign-body detection by suction air.

6. A method according to claim 1, wherein the tobacco stream is at least partially conveyed basically horizontally.

7. A method according to claim 1, wherein the tobacco stream is at least partially conveyed basically vertically.

8. A device for the separation of foreign bodies from a tobacco stream, comprising:

a foreign-body detection device;

feeding device for conveying the tobacco stream to the foreign-body detection device; and a foreign-body separation device, wherein the feeding device comprises a source of compressed air and a channel, in which the tobacco stream can be conveyed, wherein the channel includes at least a closed cross-sectional portion and a portion in the conveying direction designed to taper at least in sections in a direction cross-wise to the conveying direction.

9. A device according to claim 8, wherein a stream of compressed air conveys the tobacco stream in the feeding device.

10. A device according to claim 8, wherein tobacco is conveyed into a stream of the compressed air via a sluice.

11. A device according to claim 8, wherein the channel extends over and beyond the foreign-body separation device in the conveying direction of the tobacco stream.

12. A device according to claim 11, wherein the channel is closed at least on one side in the area of the foreign-body separation device or comprises a cover.

13. A device according to claim 8, wherein the channel opens directly in front of at least one of the foreign-body detection device and the foreign-body separation device.

14. A device according to claim 13, wherein the channel is dispersed in a funnel-shaped manner at least in sections in the conveying direction.

15. A device according to claim 13, wherein at least one wall of the channel is designed to be straight at least in sections in the conveying direction.

16. A device according to claim 8, wherein the foreign-body detection device is optical.

* * * * *